US006167602B1

(12) United States Patent
Yang et al.

(10) Patent No.: US 6,167,602 B1
(45) Date of Patent: Jan. 2, 2001

(54) LAMP REMOVAL TOOL

(75) Inventors: Chao Sheng Yang, Keelung; Jing Long Yang, Hsin-Chu, both of (TW)

(73) Assignee: Taiwan Semiconductor Manufacturing Co., Ltd., Hsin-Chu (TW)

( * ) Notice: Under 35 U.S.C. 154(b), the term of this patent shall be extended for 0 days.

(21) Appl. No.: 09/306,579

(22) Filed: May 6, 1999

Related U.S. Application Data

(63) Continuation-in-part of application No. 08/816,273, filed on Mar. 13, 1997, now abandoned.

(51) Int. Cl.[7] ..... B25B 27/14

(52) U.S. Cl. ..... 29/278; 29/739; 29/764; 294/99.2; 606/210

(58) Field of Search ..... 29/829, 278, 739, 29/762, 764; 294/99.2; 606/210

(56) References Cited

U.S. PATENT DOCUMENTS

| | | | | |
|---|---|---|---|---|
| 3,677,112 | * | 7/1972 | Keniston | 81/43 |
| 4,389,912 | * | 6/1983 | Dallons et al. | 81/43 |
| 5,320,364 | * | 6/1994 | Mistrater et al. | 279/2.17 |
| 5,367,761 | * | 11/1994 | Kabat et al. | 29/764 |
| 5,932,823 | * | 8/1999 | Jacobs | 84/411 |

* cited by examiner

*Primary Examiner*—Stephen F. Gerrity
*Assistant Examiner*—Rhonda E Sands
(74) *Attorney, Agent, or Firm*—Tung & Associates

(57) ABSTRACT

The present invention provides a novel lamp removal tool which can be used to advantageously remove a hot lamp from a lamp module that has limited access space by not requiring the cool-down of the system such that a burned-out lamp can be quickly removed and replaced causing minimal impact on the fabrication process.

11 Claims, 2 Drawing Sheets

LAMP REMOVAL TOOL

This is a request for filling a Continuation-In-Part application of pending prior application Ser. No. 08/816,273, filled on Mar. 13, 1997 now abandoned.

FIELD OF THE INVENTION

The present invention generally relates to a lamp removal tool and more particularly, relates to a lamp removal tool that can be used to remove a hot lamp from a lamp module rapidly in a semiconductor processing machine without the need of first cooling down the lamp module.

BACKGROUND OF THE INVENTION

In many industrial type heaters, heating is accomplished by using lamp heaters where high wattage lamps are used to achieve quick and efficient heating through the convection and radiation of heat. These industrial type heaters are used in drying machines, baking machines, annealing machines and in various semiconductor processing machines. The advantages of using lamp heaters as a heat source is its quick response, efficient heating and easy maintenance.

For instance, in semiconductor processing machines, a lamp module consists of a A plurality of lamp heaters is frequently used to achieve the quick and efficient heating of a reaction chamber. The processing machines include any machines that has a reaction chamber which requires heating such that the temperature of a wafer positioned in the chamber can be quickly raised to a reaction temperature. Such machines include, but are not limited to, a chemical vapor deposition (CVD) chamber, a physical vapor deposition (PVD) chamber or a sputter, an etcher for the etching or removal of semiconductor materials, a furnace for the thermal oxidation or annealing of wafers, and an ion implanters for the diffusion or implantation of dopant ions.

As an example, an illustration of a reaction chamber and its heating arrangement used in a chemical vapor deposition machines is shown in FIG. 1. For the purpose of illustration, the chemical vapor deposition machine 10 is shown only by a wafer holding device 12 and a heating device 14. The wafer holding device 12 is positioned inside a reaction chamber 18 wherein a wafer 22 is supported by a susceptor 24. The heating device 14 consists mainly of a lamp module 28 which contains and provides electrical connections to lamp heaters 32. It can be seen that electrical power is supplied to filament 34 through connectors 36 and electrical socket 38. Heat emanate from the lamp heaters 32 by both radiation and convection of heat through a quartz window 42 located at the floor 44 of the vacuum chamber 18. It should be noted that FIG. 1 is shown for illustration only and as such, the CVD machine shown is greatly simplified and that not all components of the machine are shown.

An enlarged view of the lamp module 28 is shown in FIG. 2. The lamp module, such as one that is commonly used in a chemical vapor deposition machine, is constructed of a metal that withstands high temperatures. For instance, it can be constructed of stainless steel. The lamp module 28 is generally formed in a barrel configuration with a plurality of lamp sockets 46 formed vertically in the module. In a normal semiconductor processing machine, any number between 10 and 20 sockets are used in the lamp module depending on the size of the module and the requirement of heat. The module 28 is constructed, as shown in FIG. 2, in two concentric sections 52 and 54 to facilitate cooling. The inner section 52 allows heat to dissipate toward the center cavity of the module while the outer section 54 allows heat to dissipate to the surrounding environment. The module 28 is further cooled by cooling water circulating in water tubes (not shown) on the inside of the outer periphery of the outer section 54 of the module. This protects a machine operator from severe injury should accidental touching of the module 28 occur during the operation of the CVD machine 10.

In a typical CVD machine, approximately 14 lamp heaters of 1000 W each are used in the sockets 46. The arrangement allows a wafer 22 positioned on a susceptor 24 to be heated to a temperature of well over 400° C. in a relatively short period of time so that a chemical vapor deposition process can be carried out.

During the normal operation of a semiconductor processing machine that is equipped with a lamp module, preventive maintenance is conducted during which the lamps are replaced at predetermined time intervals. For instance, for the 1000 watt lamp used in a CVD machine, the average life time for the lamp is approximately 200 hours. A preventive maintenance procedure therefore calls for the replacement of all the lamps after 200 hours usage. However, problem arises when lamps bum out pre-maturely before its scheduled replacement under the preventive maintenance schedule. For instance, during the operation of a semiconductor processing machine, various factors can cause the pre-mature burn-out of the lamps. When such burn-out occurs, the temperature uniformity in the reaction chamber is affected which results in a defective or non-uniform process to be conducted on the wafer. The wafer yield is consequently reduced. In a CVD process, when more than two lamps are burned out, the deposition process is severely affected which results in the deposition of non-uniform films on the wafer surface since the reactant gases are heated non-uniformly. In order to maintain the yield of the water fabrication process, any pre-maturely burned out lamp should be replaced as quickly as possible before the temperature of the chamber drops significantly below the reaction temperature. For instance, in a CVD process, it is desirable that the burned-out lamp heaters be replaced before the temperature of the reaction chamber drops below 250° C. At such a reaction chamber temperature, the lamps are still very hot, i.e., in the range between about 80° C. and about 150° C. It is therefore a difficult task to remove a burned-out lamp from a lamp socket when the lamp is still maintained at such a high temperature. On the other hand, if the lamp is allowed to drop below a safe-to-touch temperature, the yield of the wafer deposition process would significantly suffer.

To further complicate the task of replacing a burned-out lamp, the lamps are normally mounted in sockets that have very limited access. For instance, in a lamp module that is used in a CVD machine, the outside diameter of the lamps is approximately 25 mm, while the inside diameter of the socket (or cavity) is approximately 55 mm. The length of the lamps is approximately 60 mm which is completely submerged in the socket. This is shown in FIG. 3. The work space on each side of the lamp is therefore only approximately 15 mm for allowing a tool to reach and remove the lamp.

It is therefore an object of the present invention to provide a lamp removal tool for removing a lamp from a lamp module situated in a semiconductor processing machine that is not previously available in the industry.

It is another object of the present invention to provide a lamp removal tool that can be used in a very limited access space in a lamp socket.

It is a further object of the present invention to provide a lamp removal tool for use in a semiconductor processing machine for removing a lamp that is maintained at a high temperature.

It is still another object of the present invention to provide a lamp removal tool that is equipped with a cushion lining for gripping the lamp such that lamp breakage problems during removal can be avoided.

It is yet another object of the present invention to provide a lamp removal tool that is constructed of a high temperature material such that no contaminants can be produced by the tool.

It is another further object of the present invention to provide a lamp removal tool that has a bent tip for achieving a firm grip of the lamp such that it can be pulled out of a socket.

It is yet another further object of the present invention to provide a clamp for removing an object from a cavity of limited access space without the danger of breaking the object.

It is still another further object of the present invention to provide a method of using a lamp removal tool for removing a burned-out lamp from a lamp module of a semiconductor processing machine.

SUMMARY OF THE INVENTION

In accordance with the present invention, a lamp removal tool is provided which is capable of removing a lamp from a lamp module of limited access space without the danger of breaking the lamp or the necessity of first cooling down the lamp module so that valuable fabrication time is not lost.

In a preferred embodiment, a clamp for an article is provided which includes a first clamp half of an elongated shape having an interior surface, an exterior surface, a curved end and a flat end that is equipped with an inwardly bent tip, at least one compressible member mounted on the interior surface of the first clamp half for receiving the object, a second clamp half of an elongated shape having an interior surface, an exterior surface, a curved end for fastening to the curved end on the first clamp half in such a way that the two clamp halves may be flexed toward each other when the interior surfaces of the curved ends are fastened together, and a flat end with an inwardly bent tip for forming an opening with the flat end of the first clamp half, and at least one compressible member mounted on the interior surface of the second clamp half for receiving the object.

In another embodiment, a lamp removal tool capable of removing a lamp from a socket of limited access space is provided which includes a first clamp half that has a straight end and a bent end, a second clamp half that has a straight end and a bent end, a joint formed between the bent end of the first clamp half and the bent end of the second clamp half, an opening formed between the straight end of the first clamp half and the straight end of the second clamp half adapted for receiving a lamp thereinbetween, and a cushion member mounted in the opening for gripping the lamp.

The present invention is further directed to a method for removing an object from a cavity of limited access space which can be carried out by the operating steps of first providing a clamp that has two clamp halves, an opening formed by the two clamp halves, and a cushion lining inside the opening, wherein the opening is larger than the external dimension of the object and smaller than the internal dimension of the cavity, then positioning the clamp inside the cavity and over the object, then compressing the two clamp halves together for frictional engagement between the cushion lining and the object, and then removing the object from the cavity.

BRIEF DESCRIPTION OF THE DRAWINGS

These and other objects, features and advantages of the present invention will become apparent from the following detailed description and the appended drawings in which.

DETAILED DESCRIPTION OF THE PREFERRED AND ALTERNATE EMBODIMENTS

The present invention provides a removal tool which can be used to remove any object from a cavity that has limited access space. It is particularly suitable for use in semiconductor processing machines wherein a lamp module is used as the heating element and that a plurality of lamp sockets are provided in the lamp module to accept a plurality of lamps. The lamp removal tool can be used advantageously during a fabrication process when a lamp is pre-maturely burned out such that the tool can be used to remove a hot lamp without the need of first cooling down the lamp module and thus avoiding the loss of valuable fabrication time on the machine.

Figure 1:
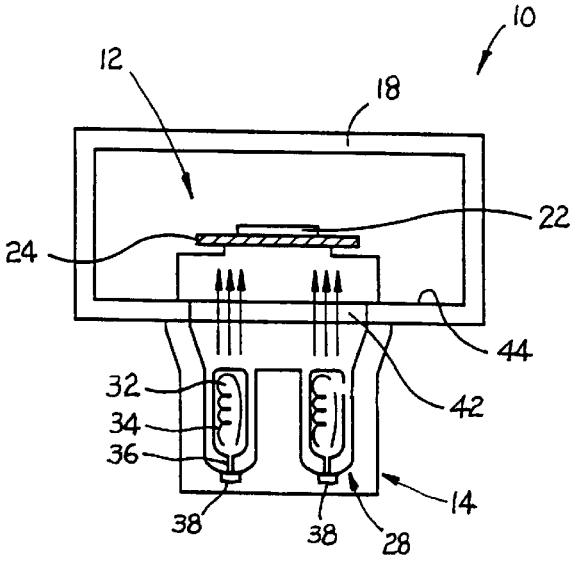
Fig 1. (Prior Art)
FIG. 1 is an illustration of the cross-section of the semiconductor processing machine consisting of a reaction chamber and a heating element.
Figure 2:
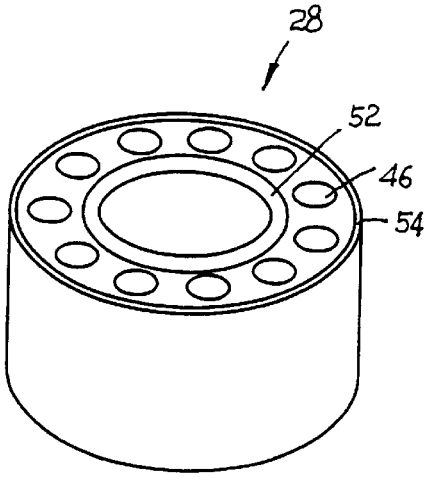
Fig 2. (Prior Art)
FIG. 2 is an enlarged, perspective view of a lamp module contained in the heating element of FIG. 1.
Figure 3:
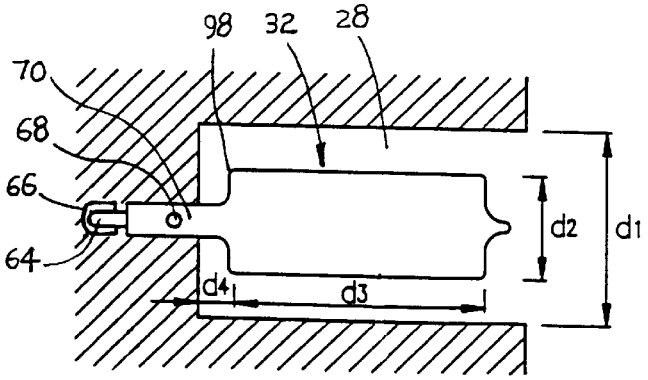
Fig 3. (Prior Art)
FIG. 3 is an enlarged, cross-sectional view of a lamp mounted in a lamp socket of a lamp module.

In a preferred embodiment, the present invention novel lamp removal tool is used to remove a lamp from a lamp socket situated in a heating element for a CVD chamber. Such a lamp/lamp socket assembly is shown in FIG. 3. Lamp 32 is seen installed in a lamp socket 28 by inserting connector 64 into electrical socket 66 for making an electrical connection. Once lamp heater 32 is in a securely plugged-in position, a screw (not shown) is mounted through aperture 68 in the neck section 70 of the lamp 32 to further secure the position of the lamp inside the socket 28. In a typical CVD heating element, the dimensions of the lamp are as follows: the external diameter of the lamp heater ($d_2$) is approximately 25 mm, the inside diameter ($d_1$) of socket 28 is approximately 55 mm, the length of the lamp ($d_3$) not including the neck section is approximately 60 mm, and the exposed neck section ($d_4$) is approximately 5 mm. From these dimensions, it can be seen that the lamp 32 is completely inserted inside the socket 28, and further that only a 15 mm space is available around the lamp 32 for the insertion of any tool to remove of the lamp. It is therefore a very difficult task without the use of a special tool such as that provided by the present invention to remove lamp 32 from socket 28.

Furthermore, in order not to lose valuable fabrication time on the process machine, a burned-out lamp must be removed and replaced without first cooling down the lamp module to a safe-touching temperature for the operator. The present invention lamp removal tool therefore enables a unique method to be carried out for removing a hot lamp from its socket.

Figure 4:
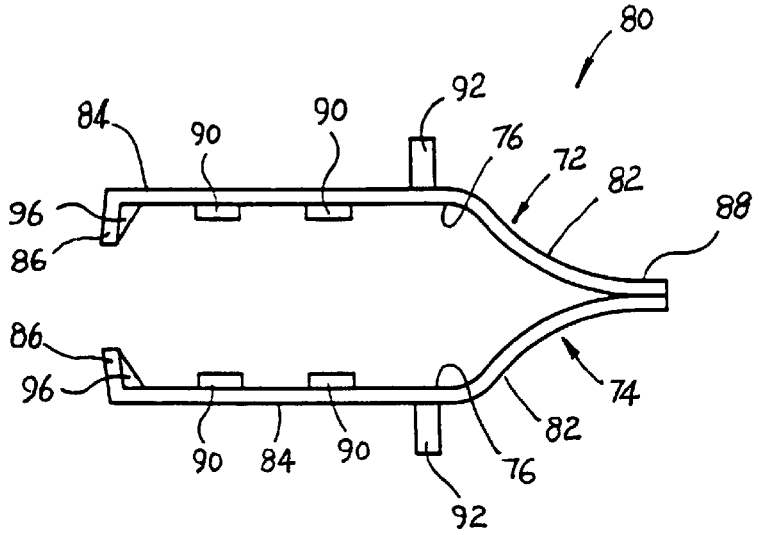
FIG. 4 is a cross-sectional view of the present invention lamp removal clamp.

A cross-sectional view of the present invention lamp removal tool is shown in FIG. 4. The lamp removal tool 80 is constructed of two clamp halves, namely a first clamp half 72 and a second clamp half 74. The first clamp half 72 has an interior surface 76, an exterior surface 78, a curved end 82 and a flat end 84 which has an inwardly bent tip 86. The first clamp half 72 has at least one compressible member 90 mounted on the interior surface 76 for providing a cushioned contact with the lamp to be removed. The second clamp half 74 is constructed in a mirror image to the first clamp half 72 with essentially the same features as the first clamp half. The compressible member has a compressive strength of not higher than 30,000 psi as determined by the ASTM standard test method D695, and a shore A durometer between 30 and 70 as determined by the ASTM standard test method D2240.

Figure 4A:
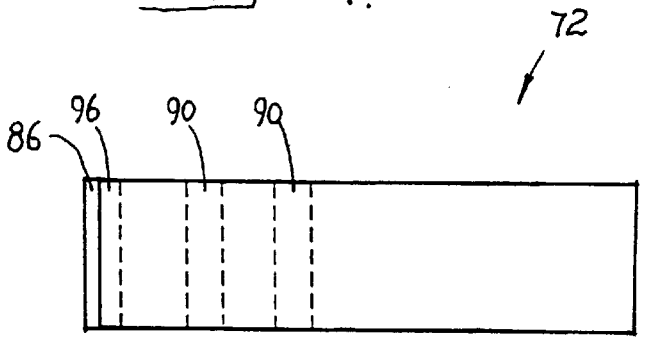
FIG. 4A is a plane view of the interior surface of the clamp half shown in FIG. 4.
Figure 5:
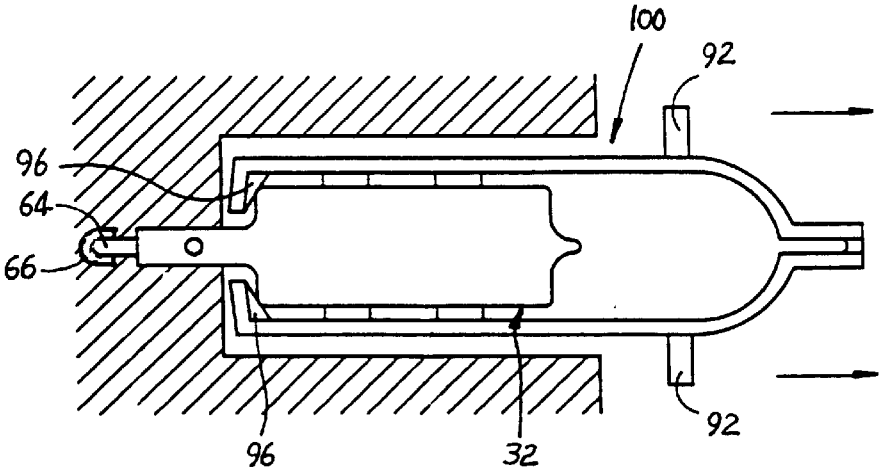
FIG. 5 is a cross-sectional view of the lamp removal clamp engaged onto a lamp inside a lamp socket.

It should be noted that while the curved end 82 shown in FIG. 4 are curved inwardly (or in a convex fashion), the curved section can also be an un-curved bent section or an outwardly curved section (or in a concave fashion as shown in FIG. 5). The first clamp half 72 and the second clamp half 74 can be constructed of a variety of materials. An important requirement for such materials is the resiliency. In other words, when the first clamp half 72 and the second clamp 74 are joined at the curved end forming a joint 88, the resiliency of the clamp material must be such that it permits the two flat ends 84 flexed toward each other and then recover to its original unflexed position. A suitable material for use is stainless steel or any other resilient metal or resilient plastic. The at least one compressible member 90 mounted on the inside surface 76 of the clamp halves can be an elastomeric material, a cellulosic material or any other compressible material that can withstand contacting with a hot surface at approximately 150° C. Frequently, high temperature rubber strips are used for the purpose. This is shown in FIG. 4A in a plane view of the clamp half 72.

To facilitate the flexing of the two clamp halves toward each other in order to grip a lamp, as shown in FIG. 5, a tab means 92 can be advantageously added to the exterior surface 78 of the clamp halves. The tab means 92 can also be used to facilitate the extraction of the lamp by pulling from the socket. It should be noted that the tab means 92 can be replaced by a roughened surface (not shown) on the exterior surface 78 of the clamp halves. For instance, the exterior surface 78 may be engraved with grooves in the perpendicular direction (same direction as the compressible strips shown in FIG. 4A).

Other than the compressible strips 90 mounted on the interior surface of the clamp halves 72 and 74, another strip of compressible material 96 may also be mounted to the inside surface of the inwardly bent tips 86 at the flat ends 84 of the clamp halves. This further provides a frictional engagement between the compressible member 96 and the surface of the lamp 32. Specifically, member 90 protects the corner 98 of the lamp from breaking or shattering during the removal process. When such shattering or breakage of the lamp occurs, serious contamination of the lamp module and possibly the reaction chamber can occur which requires a complicated cleaning process. The compressible member 96 therefore not only provides improved frictional engagement between the clamp 80 and the lamp 32, but also protects the corner 98 of the lamp.

FIG. 5 shows clamp 100 engaged with lamp 32 such that the lamp can be readily pulled out by exerting forces on tab means 92 in an outwardly direction (away from the socket). It has been discovered that in a CVD chamber, a burned-out lamp should be removed and replaced before the temperature of the reaction chamber drops below 250° C. After the bumed-out lamp is removed and replaced, the CVD chamber temperature can be quickly restored to 400° C. or higher to resume its fabrication process. The present invention novel lamp removal tool therefore accomplishes a difficult task that used to require a complete shut-down and cool-down of the CVD chamber. A satisfactory yield of the fabrication process can thus be maintained.

While the present invention has been described in an illustrative manner, it should be understood that the terminology used is intended to be in a nature of words of description rather than of limitation.

Furthermore, while the present invention has been described in terms of a preferred embodiment and an alternate embodiment, it is to be appreciated that those skilled in the art will readily apply these teachings to other possible variations of the inventions.

The embodiment of the invention in which an exclusive property or privilege is claimed are defined as follows:

1. A clamp comprising:

a first clamp half of an elongated shape having an interior surface, an exterior surface, a curved end and a flat end with an inwardly bent tip, at least one compressible member mounted on said interior surface of the flat end of said first clamp half for receiving an object, a second clamp half of an elongated shape having an interior surface, an exterior surface, a curved end for fastening to said curved end on said first clamp half in such a way that the two clamp halves may be flexed toward each other when said interior surfaces at said curved ends are fastened together, and a flat end with an inwardly bent tip for forming an opening with the flat end of said first clamp half, at least one compressible member mounted on the inside surfaces of said inwardly bent tips of said flat ends of said first and second clamp halves and at least one compressible member mounted on said interior surface of the flat end of said second clamp half for receiving an object, each said at least one compressible member mounted on said interior surfaces of said first and said second clamp half being made of a material having a compressive strength of not higher than 30,000 psi as determined by ASTM standard test method D695, and a Shore A durometer between 30 and 70 as determined by ASTM standard test method D2240.

2. A clamp according to claim 1 further comprising protrusions on said exterior surface of at least one of said first and second clamp halves to facilitate the flexing of said clamp halves toward each other.

3. A clamp according to claim 1, wherein said first and said second clamp halves are made of a resilient material.

4. A clamp according to claim 1, wherein said first and said second clamp halves are made of a resilient metal.

5. A clamp according to claim 1, wherein said second clamp half is a mirror image of said first clamp half.

6. A clamp according to claim 1, wherein said at least one compressible member is made of an elastomeric material.

7. A clamp according to claim 1, wherein said at least compressible member is capable of withstanding a temperature up to 200° C.

8. A clamp according to claim 1, wherein the curved end of said first clamp half and the curved end of said second clamp half are fastened together by mechanical means.

9. A clamp according to claim 1, wherein the curved end of said first clamp half and the curved end of s aid second clamp half are fastened together by bonding with a weld or an adhesive.

10. A clamp according to claim 1, wherein the curved end of said first and said second clamp halves are tapered to a width smaller than a width of the flat end.

11. A clamp according to claim 1, wherein the opening formed between the flat ends of said first and second clamp halves is larger than an external dimension of an object to be clamped.

* * * * *